United States Patent [19]

Sando et al.

[11] 4,087,992

[45] May 9, 1978

[54] PRESSURE SEALING DEVICE FOR HIGH PRESSURE STEAMER

[75] Inventors: Yoshikazu Sando; Hiroshi Ishidoshiro, both of Wakayama, Japan

[73] Assignee: Sando Iron Works Co., Ltd., Japan

[21] Appl. No.: 703,586

[22] Filed: Jul. 8, 1976

[30] Foreign Application Priority Data

Sep. 22, 1975 Japan ..... 50-114531

[51] Int. Cl.[2] ..... D06B 23/18

[52] U.S. Cl. ..... 68/5 E; 34/242

[58] Field of Search ..... 68/5 E; 34/242

[56] References Cited

U.S. PATENT DOCUMENTS

| | | | |
|---|---|---|---|
| 2,873,597 | 2/1959 | Fahringer | 68/5 E |
| 3,174,230 | 3/1965 | Green et al. | 34/242 X |
| 3,460,359 | 8/1969 | Schiffer | 34/242 X |
| 3,546,902 | 12/1970 | Sando et al. | 68/5 E |

*Primary Examiner*—Philip R. Coe

*Attorney, Agent, or Firm*—Toren, McGeady and Stanger

[57] ABSTRACT

A pressure sealing device for a high pressure steamer. The device comprises a main sealing body including 2 to 5 stages with a pressure reducing chamber in each stage and arranged into one unified body with a textile product passage continuously provided in the middle part of each of the pressure reducing chambers. On opposite sides of each of the upper and lower end openings of the passage provided through the main body, there are disposed a pair of seal rolls which are in pressed contact with each other in such a way as to close the opening.

4 Claims, 2 Drawing Figures

PRESSURE SEALING DEVICE FOR HIGH PRESSURE STEAMER

BACKGROUND OF THE INVENTION

This invention relates to a pressure sealing device for a high pressure steamer which is used for processing textile products under a high pressure.

High pressure steamers of the type that apply saturated steam of high temperature and high pressure to textile products for high temperature and high pressure processes are known. The present inventors have long conducted research for sealing devices that permit guiding a textile product into and out of such a steamer while maintaining the high temperature and high pressure inside the steamer. As a result of the research, the inventors have previously filed many patent applications for such sealing devices.

The sealing devices previously developed by the present inventors are either composed of at least 4 seal rolls including a pair of rubber seal rolls and a pair of metal seal rolls which are kept in pressed contact with one another or composed of such a 4 seal roll arrangement in combination with a pressure reducing chamber. In other words, each of the previous sealing devices employs a pair of rubber seal rolls in combination with metal seal rolls which are pressed against the rubber seal rolls. However, the use of 4 seal rolls in combination not only requires a high manufacturing cost in terms of materials and labor but also presents problems after such a device is put in service in terms of excessively fast wear and a high running cost resulting from great consumption of the electric power and a lubricating assistant. The present invention is, therefore, directed to the elimination of such shortcomings in conventional devices.

BRIEF SUMMARY OF THE INVENTION

It is the principal object of this invention to provide a pressure sealing device which eliminates the above stated shortcomings of the previous sealing devices of the same type.

In accordance with this invention, the sealing device comprises a main body of a sealing arrangement including 2 to 5 stages with a pressure reducing chamber in each stage and arranged into one unified body with a textile product passage continuously provided through the middle part of each pressure reducing chamber; while, on opposite sides of each end opening of the passage provided through the main body, there are disposed a pair of seal rolls which are in pressed contact with each other to close each opening. Compared with sealing devices of conventional construction in which at least 4 seal rolls are in pressed contact with one another, the cost of machining can be reduced to about 1/10 and the cost of the material to about ⅓ in accordance with this invention. The invented pressure sealing device thus brings about a great economic advantages over the conventional devices.

Other and further objects, features and advantages of this invention will appear more fully from the following detailed description of the preferred embodiments taken in connection with the accompanying drawings.

BRIEF DESCRIPTION OF THE DRAWINGS

The drawings illustrate the embodiment examples of the invented sealing device.

DETAILED DESCRIPTION OF THE INVENTION

Figure 1:
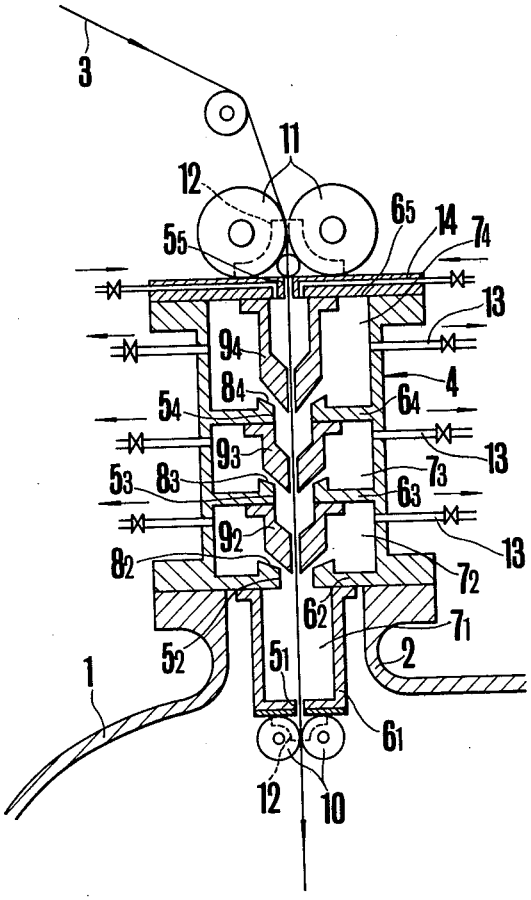
FIG. 1 is a sectional view illustrating an embodiment and FIG. 2 another sectional view illustrating another embodiment.

Referring to the attached drawings, in FIG. 1, a sealing device 4 is provided on a cloth material inlet port 2 of a drum body 1 of a high pressure steamer for the purpose of maintaining the high temperature and high pressure inside the drum. In the sealing device 4, 4 stages of pressure reducing chambers $7_1$, $7_2$, $7_3$ and $7_4$ are formed by partition walls $6_1$, $6_2$, $6_3$, $6_4$ and $6_5$ which are provided with cloth passing holes $5_1$, $5_2$, $5_3$, $5_4$ and $5_5$ respectively in their middle part for allowing a cloth material 3 to pass through the sealing device 4. With the four pressure reducing chambers thus continuously disposed stepwise, tapered valve seats $8_2$, $8_3$ and $8_4$ are formed on the upper peripheral edges of the cloth passing holes $5_2$, $5_3$ and $5_4$. Nozzles $9_2$, $9_3$ and $9_4$ which respectively allow the cloth material to pass through their middle parts are carried by the partition walls and disposed with a suitable gap left between each nozzle and a valve seat confronting it.

On the outside of each of the cloth passing holes $5_1$ and $5_5$, there are provided a pair of seal rolls 10, 11, respectively, which are in pressed contact with each other for closing the cloth passing hole. On both sides or ends of each seal roll, there are provided end face sealing plates 12. Of these pairs of seal rolls, the seal rolls 10 are made of a high temperature, high pressure resistant metal, because the high temperature and high pressure inside the drum body act directly on them. The other pair of seal rolls 11 are made of rubber as they are free from the effect of the high temperature and high pressure. An air release port 13 is provided in each pressure reducing chamber; while a pressure air blowing-in port 14 is provided for supplying air pressure or cooling air to the nozzle $9_4$. The foregoing represents the arrangements of an embodiment example of the invented sealing device. The operation of this embodiment is as described below:

With the sealing device being composed of a multistage pressure reducing chamber arrangement, valves and valve seats which are provided in between the pressure reducing chambers for giving a greater resistance to air passage, and since there are provided a pair of seal rolls 10 and the end face seal plates 12 between the pressure reducing chamber $7_1$ of the first stage and the inside of the drum body 1, the high pressure and the high temperature in the drum body 1 are reduced stepwise through these reducing chambers until no tangible pressure is applied to the reducing chamber $7_4$ which is disposed uppermost.

Therefore, the use of a pair of rubber seal rolls for closing the cloth passing hole $5_5$ of the uppermost pressure reducing chamber $7_4$ suffices for attaining the desired sealing effect and thus the object of this invention can be attained thereby.

An experimental operation of the invented sealing device was conducted as follows: Temperature inside the drum body 1 was set at 160° C (5 kg/cm$^2$G). It was then found that the temperature was reduced to 150° C inside the pressure reducing chamber $7_1$, 140° C inside the chamber $7_2$, 120° C inside the chamber $7_3$, 90° C inside the chamber $7_4$ and 60° C inside the nozzle $9_4$ while the pressure was effectively reduced also stepwise to give an excellent sealing effect.

Figure 2:
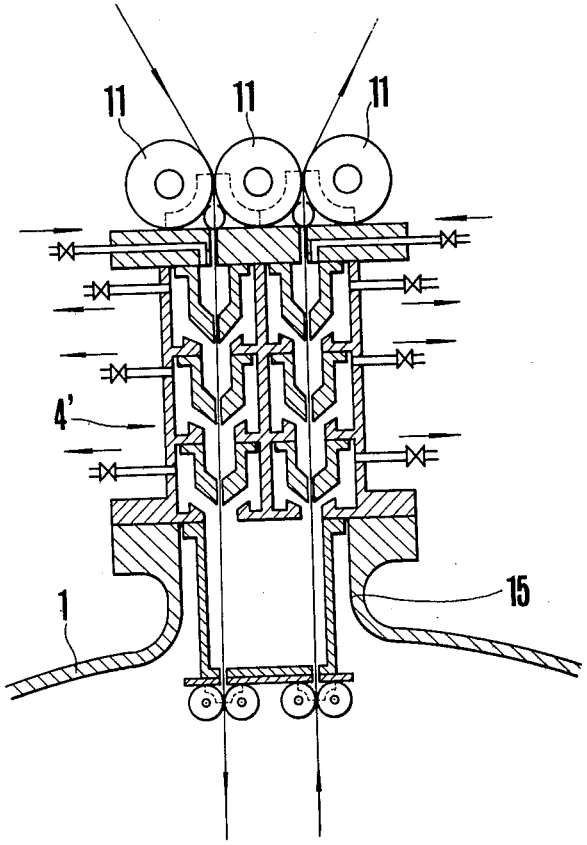

Another embodiment of this invention is illustrated in FIG. 2 in which the drum body 1 of the steamer is provided with a cloth inlet/outlet port which serves the combined purposes of guiding the cloth material into and out of the drum body. Then, the sealing device 4 of the embodiment described in the foregoing example is doubly arranged in parallel and into one unified body. This double and parallel arrangement requires only 3 seal rolls on the upper outside of the sealing body instead of 4 seal rolls. Thus, compared with the foregoing embodiment, the number of seal rolls required is further reduced by one. This means further economical advantage in terms of the cost of assembling work and that of material.

As described in the foregoing, in accordance with this invention, the metal seal rolls which have been brought into pressed contact with rubber seal rolls in the conventional sealing devices are no longer required. This improvement results in a great reduction in the degree of wear and in the consumption of electric power and lubricating assistant, so that this invention not only reduces the manufacturing cost but also brings about reduction in the running cost. Besides, a higher safety of operation is ensured by the invented sealing device.

What is claimed is:

1. A pressure dealing device for a high pressure steamer for conveying a cloth material into or out of the drum body of the high pressure steamer, comprising a main sealing body arranged to be connected to the drum body, said main sealing body having a first port arranged to open into the drum body and a second port arranged to open to the exterior of the drum body, a first pair of seal rolls located at and inwardly of said first port relative to the drum body, a second pair of seal rolls located at and outwardly of said second port relative to the drum body, in each of said first and second pair of rolls, said rolls being disposed in pressed contact with one another for closing the adjacent first and second port, partition means in combination with said main sealing body forming between two and five serially arranged pressure reducing chambers positioned between said first and second ports, and air release means associated with said pressure reducing chambers, and said pressure reducing chambers comprising a first pressure reducing chamber associated directly with said first port and at least one second pressure reducing chamber located between said first pressure reducing chamber and said second port, said partition means comprises a partition wall located between each pair of adjacent serially arranged pressure reducing chambers and each said partition wall having a cloth passing hole therethrough, each said second pressure chamber having a nozzle therein spaced inwardly from said main sealing body, said nozzle mounted on the one of said partition walls of said second pressure chamber located closer to said second port and extending therefrom toward and in spaced relation with said partition wall of said second pressure chamber located closer to said first 2. A pressure sealing device, as set forth in claim 1, wherein said air release means comprises an air release port opening into each said second pressure reducing chamber exteriorly of said nozzle therein.

3. A pressure sealing device, as set forth in claim 2, wherein each said partition wall located at the end of one said nozzle closer to said first port comprises a valve seal facing toward and spaced from said nozzle.

4. A pressure sealing device, as set forth in claim 3, wherein one of said nozzles opens to said second port, and an air pressure blowing-in port connected to said nozzle opening to said second port.

* * * * *